US010371440B2

(12) United States Patent
Hao et al.

(10) Patent No.: US 10,371,440 B2
(45) Date of Patent: Aug. 6, 2019

(54) COOLING APPLIANCE

(71) Applicant: BSH HAUSGERAETE GMBH, Munich (DE)

(72) Inventors: Jingpeng Hao, Chuzhou (CN); Mingwen Li, Chuzhou (CN); Songtao Lu, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/549,686

(22) PCT Filed: Feb. 12, 2016

(86) PCT No.: PCT/IB2016/050744
§ 371 (c)(1),
(2) Date: Aug. 9, 2017

(87) PCT Pub. No.: WO2016/128932
PCT Pub. Date: Aug. 18, 2016

(65) Prior Publication Data

US 2018/0031311 A1 Feb. 1, 2018

(30) Foreign Application Priority Data

Feb. 13, 2015 (CN) ..... 2015 1 0079611

(51) Int. Cl.
*F25D 29/00* (2006.01)
*F25D 23/02* (2006.01)
(Continued)

(52) U.S. Cl.
CPC ..... *F25D 29/005* (2013.01); *F25D 23/028* (2013.01); *F25D 25/025* (2013.01);
(Continued)

(58) Field of Classification Search
CPC .... F25D 2700/02; F25D 27/00; F25D 27/005; F25D 29/005; F25D 23/028; F25D 25/025; H01H 36/0013
See application file for complete search history.

(56) References Cited

U.S. PATENT DOCUMENTS 5,880,659 A 3/1999 Woods
5,887,446 A * 3/1999 Lee ..... F25D 27/00 200/61.62
(Continued)

FOREIGN PATENT DOCUMENTS

DE 3918085 A1 12/1989
GB 752873 A * 7/1956 ..... C04B 30/02
(Continued)

OTHER PUBLICATIONS

JP2008101803 Translated Description, 7 pages (Year: 2008).*
DE3918085A1 Translated Description, 3 pages (Year: 1989).*

*Primary Examiner* — Andrew M Roersma
(74) *Attorney, Agent, or Firm* — Laurence A. Greenberg; Werner H. Stemer; Ralph E. Locher

(57) ABSTRACT

A cooling appliance includes a cabinet, first and second doors connected to the cabinet and a door-opening detection device having a magnetic element disposed on the first door and a magnetic sensitive element disposed on the cabinet. A first magnetic conductive element on the second door can be magnetized by the magnetic element. The magnetic sensitive element can produce a door-opening signal based on a magnetic field of the first magnetic conductive element. The magnetic sensitive element produces the door-opening signal when at least one of the doors is open. In this way it can be detected, by using one suite of door-opening detection devices, if any door among multiple doors is in an open state. The structure is simple, and the number of components
(Continued)

can be reduced. Moreover, wires are reduced, which lowers manufacturing costs and difficulty.

13 Claims, 3 Drawing Sheets

(51) Int. Cl.
*F25D 25/02* (2006.01)
*H01H 36/00* (2006.01)
*H01H 3/16* (2006.01)

(52) U.S. Cl.
CPC ..... *F25D 29/00* (2013.01); *H01H 36/0013* (2013.01); *F25D 2700/02* (2013.01); *H01H 3/161* (2013.01); *H01H 36/002* (2013.01)

(56) References Cited

U.S. PATENT DOCUMENTS

2010/0320890 A1* 12/2010 Jung ..... F25D 27/00
312/402
2015/0000794 A1* 1/2015 Zou ..... C22C 38/002
148/111

FOREIGN PATENT DOCUMENTS

| | | | | |
|---|---|---|---|---|
| JP | H1012109 | A | | 1/1998 |
| JP | 2007024462 | A | * | 2/2007 |
| JP | 2008101803 | A | | 5/2008 |
| JP | 2010048487 | A | * | 3/2010 |
| JP | 2010048487 | A | | 3/2010 |
| JP | 2010065975 | A | * | 3/2010 |

* cited by examiner

COOLING APPLIANCE

BACKGROUND OF THE INVENTION

Field of the Invention

The present invention relates to a cooling appliance.

Description of the Related Art

A cooling appliance is usually provided with detection means to detect whether a corresponding door is in an open state, and performs a corresponding operation based on information of the detection means, for example, enable a corresponding lighting unit/fan, and/or a door-opening alarm unit. For example, after the door-opening alarm unit receives a door-opening signal, and a door is open for longer than a particular period of time, the cooling appliance generates an alarm, to prompt a user to close the door.

For example, the JP invention Publication No. 2008-101803 discloses detection means capable of detecting a door-opening status of two adjacent doors. Specifically, the detection means includes a magnetic element located on a first door and a magnetic sensitive sensor located on a second door, and when the first door and the second door are closed, the magnetic element and the magnetic sensitive sensor are disposed facing each other. When either of the first door and the second door is open or both the first door and the second door are open, the magnetic element and the magnetic sensitive sensor no longer face each other, and the magnetic sensitive sensor produces a door-opening signal and sends the door-opening signal to a control unit of the cooling appliance.

In the cooling appliance, a wire should be arranged for the magnetic sensitive sensor, for example, a wire should be arranged between the magnetic sensitive sensor and the control unit and/or a power module, that is, in the prior art, a wire connected to the magnetic sensitive sensor needs to be arranged in the door. This increases wiring difficulty of the cooling appliance, and further increases difficulty in detecting an open-close state of a door.

SUMMARY OF THE INVENTION

An objective of the present invention is to provide a cooling appliance that facilitates improvement, so as to resolve at least one of the foregoing technical problems.

Therefore, the present invention provides a cooling appliance. The cooling appliance includes a cabinet, a first door and a second door that are connected to the cabinet, and door-opening detection means; the door-opening detection means includes: a magnetic element disposed on the first door and a magnetic sensitive element disposed on the cabinet; the second door is provided thereon with a first magnetic conductive element capable of being magnetized by the magnetic element, and the magnetic sensitive element is capable of producing a door-opening signal based on a magnetic field of the first magnetic conductive element; and when the first door and/or the second door are/is open, the magnetic sensitive element produces the door-opening signal.

By adding the first magnetic conductive element between the magnetic sensitive element and the magnetic element, the magnetic sensitive element, for which a wire usually needs to be arranged, can be disposed on the cabinet, so that there is no need to arrange wires on the door for the magnetic sensitive element. This significantly reduces wiring difficulty and costs of a refrigerator. For a door that is connected to the cabinet by means of a guide rail, this advantage is particularly obvious.

It should be noted that, apart from the first door and the second door, the cooling appliance may further include another door in addition to the first door and the second door.

In a possible embodiment, the first door and the second door may be arranged side by side along a left-right direction, and in another possible embodiment, the first door and the second door may also be arranged side by side along an up-down direction. In another possible embodiment, the first door and the second door may not be adjacent to each other, for example, another door may further be arranged between the first door and the second door.

In a possible embodiment, the first magnetic conductive element is directly magnetized by the magnetic element, for example, one end of the first magnetic conductive element approaches the magnetic element and is magnetized. In an alternative possible embodiment, the first magnetic conductive element may also be "indirectly" magnetized by a second magnetic conductive element that conducts a magnetic field of the magnetic element.

The magnetic sensitive element may be, for example, a Hall element, a magnetoresistor, or a magnetic reed switch. As a possible embodiment of "the magnetic sensitive element is capable of producing a door-opening signal based on a magnetic field of the first magnetic conductive element", the magnetic sensitive element may produce the door-opening signal when the magnetic sensitive element does not detect the magnetic field of the first magnetic conductive element or the magnetic field detected by the magnetic sensitive element is less than a preset value. The door-opening signal may include, for example, an electric signal (such as a pulse signal or opening/closing of a switch).

Optionally, the magnetic element may be located on one side, facing the second door, of the first door. This helps the magnetic element magnetize the first magnetic conductive element.

Optionally, when the first door and the second door are closed, one end of the first magnetic conductive element along a length direction approaches the magnetic element, and the other end departs from the magnetic element and approaches the magnetic sensitive element. When this requirement is satisfied, the first magnetic conductive element may extend along any direction on the second door. On one hand, this can ensure a sufficient distance between the magnetic element and the magnetic sensitive element, to prevent the magnetic field of the magnetic element from interfering with the magnetic sensitive element. On the other hand, the first magnetic conductive element can be reliably magnetized by the magnetic element, and it helps the magnetic sensitive element detect the magnetic field of the magnetized first magnetic conductive element.

For example, when the first door and the second door are arranged along the up-down direction, the first magnetic conductive element may extend along an up-down direction of the cabinet or extend along a left-right direction of the cabinet.

When the first magnetic conductive element extends along the up-down direction of the cabinet, a length extending direction of the first magnetic conductive element may be parallel to the arrangement direction of the first door and the second door, or may form an angle with the arrangement direction of the first door and the second door.

Optionally, the second door has a first end facing the first door and a second end away from the first door, and the first magnetic conductive element extends from the first end of the second door to the second end of the second door.

Optionally, when the second door is closed, the magnetic sensitive element is opposite to one end, away from the magnetic element, of the first magnetic conductive element.

In a possible embodiment, the first door and the second door may be arranged along the up-down direction of the cabinet, the magnetic element is mounted at a lower end of the first door, and the first magnetic conductive element extends from an upper end of the second door to a lower end of the second door. When the second door is closed, the magnetic sensitive element is opposite to a lower end of the first magnetic conductive element. Therefore, when the first door and the second door are closed, an upper end of the first magnetic conductive element approaches the magnetic element, and is magnetized to produce a magnetic field, and the lower end of the first magnetic conductive element approaches the magnetic sensitive element, which helps the magnetic sensitive element detect the magnetic field of the first magnetic conductive element/detect sufficient magnetic field intensity.

Optionally, when the second door is closed, the magnetic sensitive element can be covered by the second door.

Optionally, when the second door is closed, the first magnetic conductive element is opposite to the magnetic sensitive element along a front-rear direction of the cabinet. In this case, the magnetic sensitive element is close enough to the first magnetic conductive element, so that the magnetic sensitive element can accurately sense the magnetic field of the first magnetic conductive element.

Optionally, the first door and the second door close a same storage chamber. As long as either of the first door and the second door is open or both the first door and the second door are open, the magnetic sensitive element produces a door-opening signal, so that the door-opening detection means can detect whether the storage chamber closed by the first door and the second door is open.

Optionally, the magnetic sensitive element may be located on a side wall, away from the first door, of the storage chamber. This helps increase a distance between the magnetic sensitive element and the magnetic element, which is conducive to preventing the magnetic sensitive element from being directly affected by the magnetic field of the magnetic element.

Optionally, the cooling appliance may further include a third door located between the first door and the second door, and the door-opening detection means further includes a second magnetic conductive element disposed on the third door; the second magnetic conductive element is capable of being magnetized by the magnetic element and conducting a magnetic field of the magnetic element to the first magnetic conductive element, so as to magnetize the first magnetic conductive element. For any number of doors arranged sequentially along one direction in the cooling appliance, a second magnetic conductive element may be disposed on each of the doors, so that the magnetic element and the magnetic sensitive element are separately disposed at two ends of a magnetic unit, to implement detecting open-close states of multiple doors by using one suite of the magnetic element and magnetic sensitive element.

Optionally, the second magnetic conductive element extends along a direction from the first door to the second door.

Optionally, one end of the second magnetic conductive element along a length direction is close to one of the first door and the second door, and the other end is close to the other one of the first door and the second door.

Optionally, when the second door and the third door are both closed, the first magnetic conductive element and the second magnetic conductive element at least partially overlap along an arrangement direction of the second door and the third door. Such arrangement achieves the following objective: when the second door and the third door are both closed, along a front-rear direction of the cabinet, the first magnetic conductive element and the second magnetic conductive element are basically located at a same location, which is conducive to conduction of the magnetic field. In a possible embodiment, when the second door and the third door are both closed, along the front-rear direction of the cabinet, the first magnetic conductive element and the second magnetic conductive element are exactly at a same location, that is, completely overlap along the arrangement direction of the second door and the third door.

Optionally, there are multiple third doors, and the multiple third doors are arranged along the direction from the first door to the second door.

Optionally, the magnetic element may include a magnet. The first magnetic conductive element and the second magnetic conductive element may include silicon steel sheets.

Optionally, the first magnetic conductive element may be disposed in a housing of the second door, and the second magnetic conductive element may be disposed in a housing of the third door. In this way, the first magnetic conductive element and the second magnetic conductive element can be reliably fixed in the doors without affecting the appearance of the cooling appliance.

Optionally, the first door and the second door may be separately connected to the cabinet by using a guide rail. Even if the first door and the second door perform translational movement relative to the cabinet, where wiring is inapplicable or wiring difficulty is increased, door-opening states of the first door and the second door can still be detected.

Optionally, the cooling appliance may further include a control unit and execution units, where a signal-based connection is established between the control unit and the execution units; the control unit receives the door-opening signal of the magnetic sensitive element, and controls actions of the execution units according to the induced signal. The magnetic sensitive element may send the door-opening signal to either of the execution units or to both of the execution units at the same time, and the control unit controls the actions of the execution units.

Optionally, the execution unit may include alarm means and/or lighting means.

BRIEF DESCRIPTION OF THE SEVERAL VIEWS OF THE DRAWING

The disclosure will become more fully understood from the detailed description given herein below for illustration only, and thus are not limitative of the disclosure, and wherein.

DESCRIPTION OF THE INVENTION

To make the foregoing objectives, features, and advantages of the present invention more comprehensible, specific embodiments of the present invention are described in detail below with reference to the accompanying drawings.

First Embodiment

Figure 1:
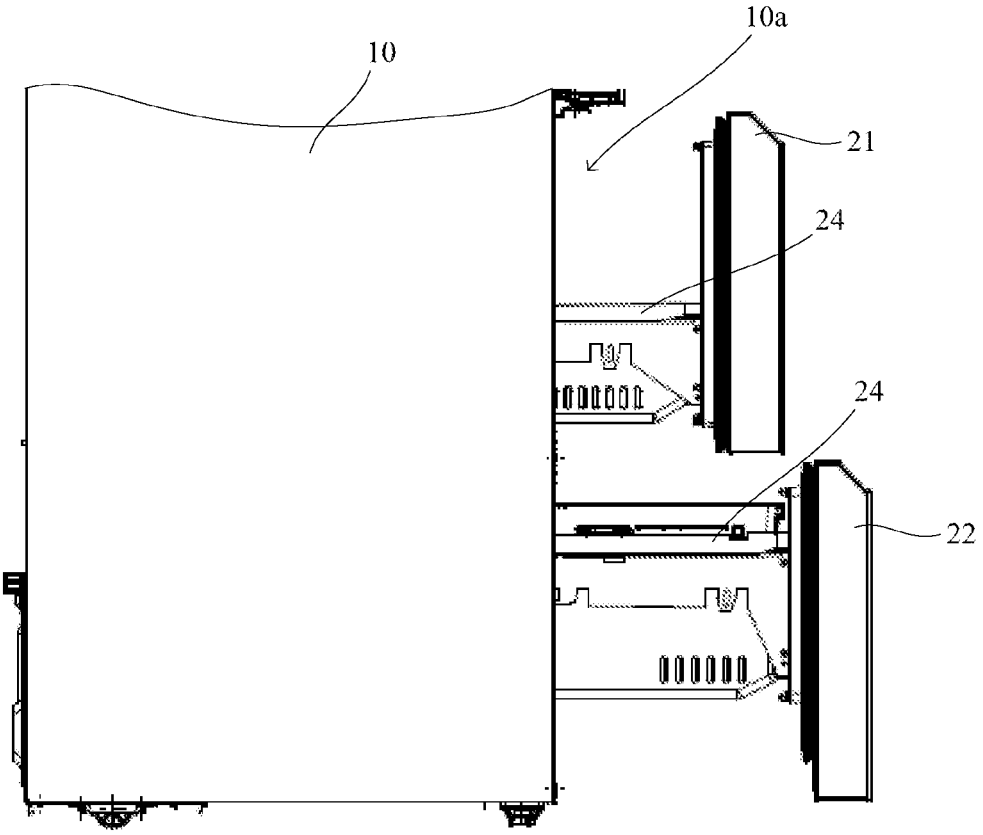
FIG. 1 is a view along a side-view direction of a cooling appliance in a first embodiment of the present invention, where a first door and a second door are both in an open state.
Figure 2:
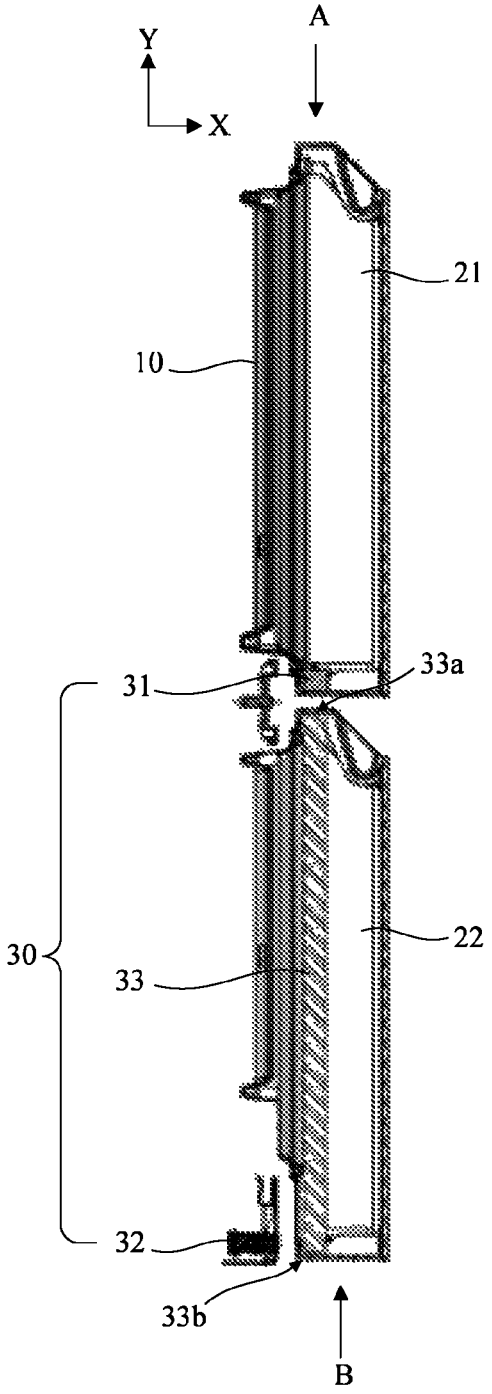
FIG. 2 is a partial sectional view along the side-view direction of the cooling appliance in the first embodiment of the present invention, where the first door and the second door are both in a closed state.

This embodiment of the present invention provides a cooling appliance. With reference to FIG. 1 to FIG. 2, the cooling appliance includes a cabinet 10, multiple doors that are connected to the cabinet 10 and used to close a storage chamber 10*a*, and door-opening detection means 30. Two adjacent doors are considered as a group, and one group of doors corresponds to one piece of door-opening detection means 30. Two doors in a same group of doors are referred to as a first door 21 and a second door 22 respectively, as shown in the figures. Besides, there may be one storage chamber 10*a* or multiple storage chambers 10*a*, and multiple doors may close a same storage chamber 10*a* or close different storage chambers 10*a*. The storage chamber 10*a* may be a refrigerating chamber or a freezing chamber, and the solution of this embodiment is particularly suitable for the freezing chamber.

The door-opening detection means 30 includes: a magnetic element 31 disposed on the first door 21 and a magnetic sensitive element 32 disposed on the cabinet 10; the second door 22 is provided thereon with a first magnetic conductive element 33 capable of being magnetized by the magnetic element 31, and the magnetic sensitive element 32 produces a door-opening signal based on a magnetic field of the first magnetic conductive element 33; when the first door 21 and/or the second door 22 are/is open, the magnetic sensitive element 32 produces the door-opening signal.

The cooling appliance further includes a control unit and execution units (not shown in the figures), where a signal-based connection is established between the control unit and execution units; the control unit receives the door-opening signal of the magnetic sensitive element, and controls actions of the execution units according to the induced signal.

The magnetic sensitive element 32 may have a signal-based connection to the control unit in a wired manner or a wireless manner, and can send the induced door-opening signal to the control unit, and then the control unit sends instructions to the execution units, so that the execution units perform corresponding actions. The execution unit includes alarm means and/or lighting means. When the magnetic sensitive element 32 does not send a door-opening signal, the alarm means does not generate an alarm, or the lighting means does not emit light; when the magnetic sensitive element 32 sends a door-opening signal, the control unit sends an alarm instruction to the alarm means, so that the alarm means generates an alarm (it is generally required herein that, the alarm means sends an alarm instruction only when a door-opening time reaches a given period), or the control unit sends a lighting instruction to the lighting means, so that the lighting means emits light.

Specifically, a location relationship among the magnetic element 31, the magnetic sensitive element 32, and the first magnetic conductive element 33 should satisfy the following requirements:

First, the magnetic sensitive element 32 and the magnetic element 31 should be spaced by a sufficient distance, so that the magnetic field of the magnetic element 32 does not interfere with the magnetic sensitive element 32.

Secondly, when the first door 21 and the second door 22 are both closed, the magnetic element 31 and the first magnetic conductive element 33 should be close enough, so that the first magnetic conductive element 33 can be magnetized by the magnetic element 31.

Thirdly, when the second door 22 is closed, the magnetic sensitive element 32 and the first magnetic conductive element 33 should be close enough, so that the magnetic sensitive element 32 can detect the magnetic field of the first magnetic conductive element 33, and when the detected magnetic field is higher than a set value of the magnetic sensitive element 32, the magnetic sensitive element does not send a signal; and when the detected magnetic field is lower than the set value of the magnetic sensitive element 32 or no magnetic field is detected, the magnetic sensitive element 32 sends a door-opening signal.

The magnetic element 31 is a medium capable of producing a magnetic field, for example, a magnet. The magnetic sensitive element 32 may be a magnetic switch, a magnetic sensitive sensor, or the like. The first magnetic conductive element 33 needs to be a medium capable of being magnetized easily with little remanence, and optimally, a medium capable of being magnetized easily without any remanence, for example, a silicon steel sheet. In this way, when the distance between the first magnetic conductive element 33 and the magnetic element 31 reaches a particular value, the first magnetic conductive element 33 is not magnetized, and therefore, no magnetic field is produced.

The first magnetic conductive element 33 in this embodiment is a silicon steel sheet. When the first door 21 and the second door 22 are both closed, the first magnetic conductive element 33 is magnetized, and the magnetic sensitive element 32 can detect a sufficiently strong magnetic field, and therefore does not send a door-opening signal; when either of the first door 21 and the second door 22 is open, the first magnetic conductive element 33 and the magnetic element 31 are staggered, and in this case, the first magnetic conductive element 33 cannot be magnetized and has no remanence, that is, the first magnetic conductive element 33 cannot produce a magnetic field, and magnetic field intensity detected by the magnetic sensitive element 32 is zero; therefore, the magnetic sensitive element 32 sends a door-opening signal. When the first door 21 and the second door 22 are both open, even if the first magnetic conductive element 33 can be magnetized by the magnetic element 31 in this case, the magnetic sensitive element 32 can still send a door-opening signal because an increase in the distance between the first magnetic conductive element 33 and the magnetic sensitive element 32 makes the magnetic field intensity detected by the magnetic sensitive element 32 decrease and be lower than the set value.

In this embodiment, the first magnetic conductive element 33 has a first end 33*a* and a second end 33*b* along a length direction; when the first door 21 and the second door 22 are both closed, the first end 33*a* of the first magnetic conductive element 33 approaches the magnetic element 31, and the second end 33*b* approaches the magnetic sensitive element 32. In this way, the location relationship among the magnetic element 31, the magnetic sensitive element 32, and the first magnetic conductive element 33 satisfies the foregoing three requirements. On the premise of not affecting normal operation of the cooling appliance, the magnetic element 31, the magnetic sensitive element 32, and the first magnetic conductive element 33 may be disposed on outer surfaces of or inside the corresponding doors, or on an outer surface of or inside the cabinet.

Specifically, the first end 33*a* of the first magnetic conductive element 33 is located at an end, close to the first door 21, of the second door 22, and the second end 33*b* is located at an end, away from the first door 21, of the second door 22. In other words, the length of the first magnetic conductive element 33 is the same as the length (or width), along an arrangement direction of the two doors, of the second door 2.

The magnetic element 31 is disposed on a side, facing the second door 22, of the first door 21, that is, a side, facing the first magnetic conductive element 33, of the first door 21, so as to transfer the magnetic field to the first magnetic conductive element 33 and magnetize the first magnetic conductive element 33. The magnetic element 33 is located in a housing of the first door 21, to ensure a beautiful appearance.

The magnetic sensitive element 32 is disposed on the cabinet 10, and may be disposed on a side surface or a front surface of the cabinet 10, as long as the magnetic field of the first magnetic conductive element 33 can be detected. In this embodiment, it is set that when the second door 22 is closed, the magnetic sensitive element 32 is covered by the second door 22. For example, it may be set that when the second door 22 is closed, the first magnetic conductive element 33 is opposite to the magnetic sensitive element 32 along a front-rear direction (direction X in FIG. 2) of the cabinet 10, that is, the first magnetic conductive element 33 and the magnetic sensitive element 32 have an overlapping part along the front-rear direction of the cabinet 10. The magnetic sensitive element 32 is embedded in the housing of the cabinet 10, and an end, facing the second door 22, of the magnetic sensitive element 32 is exposed. In this way, the magnetic sensitive element 32 can accurately detect the magnetic field of the first magnetic conductive element 33, thereby accurately sending a signal.

The first magnetic conductive element 33 is disposed in a housing of the second door 22, to ensure a beautiful appearance. Specifically, a side, along a thickness direction of the second door 22, of the first magnetic conductive element 33 is inserted in a thermal insulating layer of the second door 22, and the other side leans against an inner wall, facing a side of the storage chamber 10*a*, of the housing of the second door 22.

In this embodiment, the first door 21 and the second door 22 close the same storage chamber 10*a*. In this way, no matter which door is open, the door-opening detection means 30 can accurately detect that the storage chamber 10*a* is open.

The magnetic sensitive element 32 is located on a side wall, away from the first door, of the storage chamber 10*a*. For example, when the first door 21 and the second door 22 are arranged along an up-down direction of the cabinet 10 (direction Y in the figure), the magnetic element 31 is mounted at a lower end of the first door 21, and the first magnetic conductive element 33 extends from an upper end of the second door 22 to a lower end of the second door 22, and the magnetic sensitive element 32 is located on a bottom wall of the storage chamber 10*a*. When the second door 22 is closed, the magnetic sensitive element 32 is opposite to a lower end of the first magnetic conductive element 33. In another embodiment, the first magnetic conductive element may extend along any direction in a plane of the second door, for example: the first magnetic conductive element may extend along a horizontal direction of the second door, where one end of the first magnetic conductive element approaches the magnetic element, and the other end of the first magnetic conductive element approaches the magnetic sensitive element.

It should be noted that, an opening manner of the doors in the cooling appliance is not limited, for example, the doors may be hinged doors rotatable relative to the cabinet, or may be drawer-type push-pull doors, or sliding doors. In this embodiment, the first door 21 and the second door 22 are both drawer-type push-pull doors, which are separately connected to the cabinet 10 by using a guide rail 24, and can move away from or towards the cabinet along the direction X. In addition, the first door and the second door may also be arranged along a horizontal direction.

Second Embodiment

Figure 3:
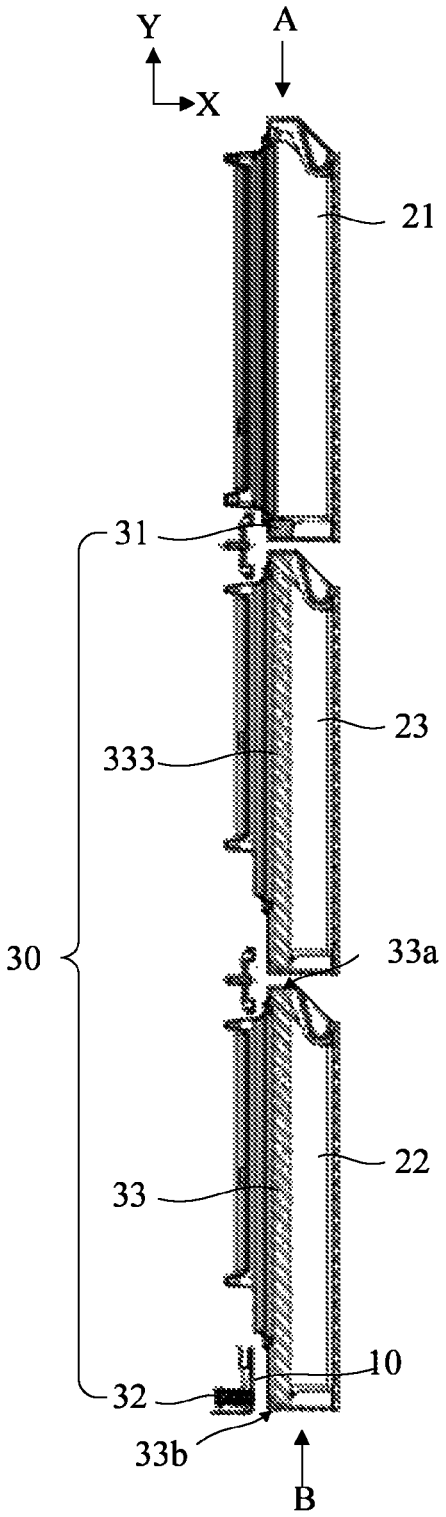
FIG. 3 is a partial sectional view along a side-view direction of a cooling appliance in a second embodiment of the present invention, where a first door, a second door, and a third door are all in a closed state.

This embodiment differs from the first embodiment in that: referring to FIG. 3, at least one third door 23 is further arranged between the first door 21 and the second door 22, the door-opening detection means 30 further includes a second magnetic conductive element 333 disposed on the third door 23; the second magnetic conductive element 333 on the third door 23 is capable of being magnetized by the magnetic element 31, and conducting a magnetic field of the magnetic element 31 to the first magnetic conductive element 33 of the second door 22, so as to magnetize the first magnetic conductive element 33 of the second door 22.

In this embodiment, the second magnetic conductive element 333 on the third door 23 extends along a direction from the first door 21 to the second door 22.

One end of the second magnetic conductive element 333 along a length direction is close to one of the first door 21 and the second door 22, and the other end is close to the other one of the first door 21 and the second door 22.

The second magnetic conductive element 333 in this embodiment is also a silicon steel sheet.

In another embodiment, there may be multiple third doors, and the multiple third doors are arranged along a direction from the first door to the second door. However, it should be understood that, as the number of doors increases, the magnetic field of the magnetic element is required to have higher intensity, so that the magnetic field can smoothly reach the second door from the magnetic element through the third doors sequentially. Although the present invention is disclosed above, the present invention is not limited thereto. Any person skilled in the art can make various changes and modifications without departing from the spirit and scope of the present invention. Therefore, the protection scope of the present invention should be subject to the scope defined by the claims.

What is claimed is:

1. A cooling appliance, comprising:

a cabinet;

a first door and a second door connected to said cabinet, said first door having a side facing said second door, said second door having a first end facing said first door and a second end facing away from said first door;

a door-opening detection device including a magnetic element disposed at said first door, a first magnetic conductive element, and a magnetic sensitive element disposed at said cabinet, said magnetic element being located on said side of said first door facing said second door;

said first magnetic conductive element disposed on said second door, said first magnetic conductive element being magnetizable by said magnetic element, said first magnetic conductive element extending from said first end of said second door to said second end of said second door, said first magnetic conductive element having a first end proximate to said second end of said second door;

said magnetic sensitive element being adjacent to said first end of said first magnetic conductive element when said second door is closed; and said magnetic sensitive element being configured to produce a door-opening signal based on a magnetic field of said magnetic element, said magnetic field of said magnetic element conducted via said first magnetic conductive element to the first end thereof and sensed by said magnetic sensitive element when said first and second doors are both closed, and said magnetic sensitive element producing the door-opening signal upon opening of either or both of said first and second doors, thereby making said magnetic field of said magnetic element undetected by said magnetic sensitive element.

2. The cooling appliance according to claim 1, wherein: said first magnetic conductive element has said first end and a second end along a length direction; and when said first door and said second door are closed, said second end of said first magnetic conductive element approaches said magnetic element and said first end of said first magnetic conductive element is remote from said magnetic element and approaches said magnetic sensitive element.

3. The cooling appliance according to claim 1, wherein said magnetic sensitive element is covered by said second door when said second door is closed.

4. The cooling appliance according to claim 1, wherein said cabinet has a front-rear direction, and said first magnetic conductive element is adjacent to said magnetic sensitive element along said front-rear direction of said cabinet when said second door is closed.

5. The cooling appliance according to claim 1, wherein said first door and said second door are disposed side by side along an up-down direction or a left-right direction of said cabinet; and said first door and said second door are adjacent each other.

6. The cooling appliance according to claim 1, which further comprises:

at least one third door located between said first door and said second door;

said door-opening detection device including a second magnetic conductive element disposed on said at least one third door;

said second magnetic conductive element being magnetizable by said magnetic element; and said second magnetic conductive element conducting said magnetic field of said magnetic element to said first magnetic conductive element, so as to magnetize said first magnetic conductive element.

7. The cooling appliance according to claim 6, wherein said second magnetic conductive element extends along a direction from said first door to said second door.

8. The cooling appliance according to claim 6, wherein:

said second magnetic conductive element has a length direction;

said second magnetic conductive element has one end along said length direction disposed closer to one of said first door or said second door; and said second magnetic conductive element has another end along said length direction disposed closer to another of said first door or said second door.

9. The cooling appliance according to claim 6, wherein:

said second door and said at least one third door define a direction; and said first magnetic conductive element and said second magnetic conductive element at least partially overlap along said direction defined by said second door and said at least one third door when said second door and said at least one third door are both closed.

10. The cooling appliance according to claim 6, wherein said at least one third door includes a plurality of third doors, and said plurality of third doors are disposed along a direction from said first door to said second door.

11. The cooling appliance according to claim 6, wherein said first magnetic conductive element and said second magnetic conductive element include silicon steel sheets.

12. The cooling appliance according to claim 6, wherein:

said second door and said at least one third door each have a respective housing;

said first magnetic conductive element is disposed in said housing of said second door; and said second magnetic conductive element is located in said housing of said at least one third door.

13. The cooling appliance according to claim 1, wherein said magnetic element is a single magnetic element and said magnetic sensitive element is a single magnetic sensitive element.

* * * * *